US005817398A

United States Patent [19]

Hollander

[11] Patent Number: 5,817,398

[45] Date of Patent: Oct. 6, 1998

[54] METHOD AND APPARATUS FOR MANUFACTURING BANDS OF BITUMINIZED ROOFING

[75] Inventor: Jan Hollander, Zuidhorn, Netherlands

[73] Assignee: Esha Holding B.V., Groningen, Netherlands

[21] Appl. No.: 755,328

[22] Filed: Nov. 20, 1996

[30] Foreign Application Priority Data

Nov. 21, 1995 [NL] Netherlands ..... 1001711

[51] Int. Cl.[6] ..... B32B 9/00

[52] U.S. Cl. ..... 428/141; 428/144; 428/289; 428/291; 428/302; 428/319.7; 428/373; 428/458; 428/902; 427/365; 427/366; 427/369; 427/370; 427/424; 156/237; 156/252; 156/253

[58] Field of Search ..... 428/287, 289, 428/291, 297, 489, 298, 302, 373, 902, 319.7, 141, 102, 127, 458, 408, 144; 156/252, 253, 237, 280, 285, 337; 225/99; 427/369, 370, 366

[56] References Cited

U.S. PATENT DOCUMENTS 4,940,501 7/1990 Hollander ..... 156/252

*Primary Examiner*—William Krynski
*Assistant Examiner*—Abraham Bahta
*Attorney, Agent, or Firm*—Welsh & Katz, Ltd.

[57] ABSTRACT

A method for manufacturing bands of bituminized roofing material, wherein a band of porous carrier material is impregnated with bitumen, wherein the band of porous carrier material is provided on a supporting surface provided with openings, hot bitumen is provided on the side of the band of carrier material remote from the supporting surface, and a pressure difference is created across the supporting surface, so that the hot bitumen penetrates into the carrier material.

19 Claims, 3 Drawing Sheets

METHOD AND APPARATUS FOR MANUFACTURING BANDS OF BITUMINIZED ROOFING

FIELD OF THE INVENTION

This invention relates to a method for manufacturing bands of bituminized roofing material, wherein a band of porous carrier material is impregnated with bitumen, as well as to an apparatus for carrying out the method.

DESCRIPTION OF THE RELATED ART

According to the conventional technique, a band of carrier material, also referred to as inlay, for instance a band of glass fibre web material, is passed along a serpentine path formed by guide rollers arranged alternately high and low, through a bath with heated bitumen. The heated bitumen is contained in a kind of tub in which also the guide rollers are arranged. On the outlet side of the tub, the bitumen-soaked band of carrier material is pulled through two pressing rollers spaced apart with a slight interspace. The pressing rollers work as a kind of wringer, which removes excess bitumen and causes it to flow back into the tub. Also, the wringer promotes a good penetration of the bitumen into the carrier material. Then, in a next station, a coating is applied and the thickness of the band is calibrated.

A drawback of the known technique is that the carrier material is continuously subject to a non-negligible tensile force which is needed to pass the band through the bitumen bath. The tensile force exerted on the carrier material can lead to stretch of the material. This danger is further augmented by the heating which takes place in the bitumen bath. The temperature in the bitumen bath can be, for instance, 170° to 180° C. Accordingly, there is a chance that mechanical stresses prevail in the roofing material manufactured in the conventional manner described, which stresses are released if the material is exposed to an increased temperature again. This then becomes manifest in shrinkage of the material in finished condition.

Since on summery days the temperature on a roof can rise as high as 70° to 80° C., it ray happen that the roofing material then starts to shrink. Obviously, the watertightness of the fitted roofing is then no longer ensured.

The above-described shrinkage effect can be counteracted by using a firm band of carrier material which, due to the nature of the material from which the band is manufactured and/or by the manner in which the band has been manufactured from the base material, is resistant to a sufficient extent to the forces induced during the bituminization process. The conventional production process accordingly limits the freedom of choice of the carrier material and prevents in particular the use of less firm, pliable carrier bands, although this is often desirable in connection with the conditions on the roof. For a more pliable material more readily allows of folding, and more readily follows root connections and differences in level, local unevennesses, details, etcetera, of the roof.

Another drawback of the conventional production process is that the band of carrier material often contains moisture and also air, which is incorporated into the bitumen in the tub, especially in the case of polymeric bitumen, which is undesired. Further, the bitumen flowing back into the tub from the calibrating rollers entrains air, which can jeopardize the watertightness of the end product and so is highly undesirable.

A third drawback of the conventional production method is that it is not properly possible to produce roofing material with a strengthened edge. Such a strengthened edge is desirable if the material is to allow fastening with nails or the like. A strengthened edge can be obtained, for instance, by folding over the side edges of the carrier material, yielding longitudinal edges of double material thickness. Such thicker edges, however, prevent a proper action of the above-described wringer on the outlet side of the bitumen bath.

Also, when used on a sloping roof surface, the conventionally manufactured bituminous roofing material involves the danger of shear between the carrier and the layer of bitumen provided thereon.

SUMMARY OF THE INVENTION

The object of the invention is to obviate the drawbacks outlined and in general to make available an improved method for manufacturing bands of bituminized roofing material, which is less dependent on the material and the mechanical stability of the carrier band; and with which, depending on the carrier material, a supple product can be manufactured which is also a stable product, that is, a product which hardly, if at all, exhibits any stretch or shrinkage phenomena and which is suitable to be applied to both horizontal and inclined roof surfaces, with or without the aid of a burner or blower.

According to the invention, a method of the above-described type is characterized in that the band of porous carrier material is arranged on a supporting surface provided with openings, that hot bitumen is provided on the side of the band of carrier material remote from the supporting surface and that across at least a part of the supporting surface a pressure difference is created between the one and the other side of the supporting surface, whereby hot bitumen penetrates the carrier material.

An apparatus for manufacturing bands of bituminized roofing material is characterized, according to the invention, by a supporting surface, provided with openings, for the band of porous carrier material, means for at least locally generating a pressure difference between the one and the other side of the supporting surface, and a hot bitumen supply device arranged on the side of the supporting surface where the highest pressure prevails.

It is observed that German Offenlegungsschrift 1769556 discloses an apparatus for manufacturing roof felt, wherein use is made of reduced pressure. In this known technique, however, the reduced pressure is created on both sides of the carrier material, in order to promote the evaporation of moisture from the carrier material. However, the reduced pressure does not serve for impregnating the carrier with bitumen.

BRIEF DESCRIPTION OF THE DRAWINGS

Hereinafter the invention will be further described with reference to the accompanying drawings of an exemplary embodiment.

DESCRIPTION OF THE PREFERRED EMBODIMENTS

Figure 1:
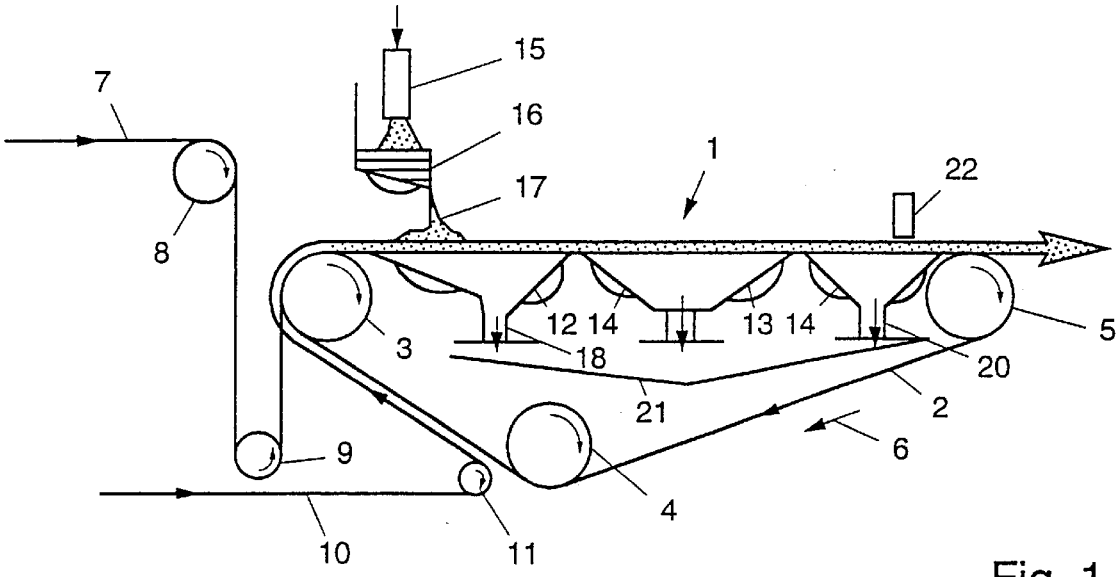
FIG. 1 schematically shows an elevation of an example of an apparatus according to the invention.

FIG. 1 schematically shows in side elevation a first example of an apparatus according to the invention. The apparatus shown comprises a circular conveyor 1, which in this example consists of an endless belt 2; provided with openings, which has been passed over a number of supporting and return rollers 3, 4, 5. At least one of the rollers is drivable through a drive mechanism, not shown. The belt 2 can be, for instance, a screen belt of the type that is also used in machines for manufacturing paper and cardboard. In the example shown, the belt 2 is driven clockwise, as indicated by arrow 6. In its upper path, the belt therefore moves from the left to the right. From the left-hand side of the conveyor 1 a band of carrier material is supplied in such a manner that it ends up flat on the screen belt 2. Depicted is a first material band 7 which is supplied via a fixed roller 8 and a dancing roller 9. The dancing roller keeps the material band tight and also causes the material band 7 to be fed to some extent from below adjacent the return roller 3. As a result, directly at the beginning of the conveyor the material band comes to lie properly on the conveyor.

The band of carrier material can consist of more than one layer and the layers can optionally consist of different materials. By way of example, a second band of carrier material 10 is shown, which is supplied via a roller 11, in such a manner that the band 10 comes to lie under the band 7. The band 7 can consist, for instance, of polyester material or polypropene, and the band 10, for instance, of glass fabric. Instead of a band of glass fabric, or even in combination therewith, a lattice of glass fibres or other suitable fibres can be used or a number of fibres extending in the longitudinal direction. Such fibres can also have been incorporated into the band 7 as reinforcement fibres or be supplied together with the band 7.

Located directly under the upper path of the screen belt are one or more vacuum chambers. In the example shown, three vacuum chambers 12, 13, 14 are drawn. The vacuum chambers are connected to a device (not shown) which can create a reduced pressure in the chambers, which can preferably be set for each chamber. The vacuum chambers are preferably provided with a perforated plate or supporting rollers or other means for supporting the screen belt.

Shown above the upper path of the conveyor 1 is a supply device 15 for hot bitumen, as well as a distributing device 16 for the bitumen, which distributes the bitumen over the width of the conveyor. In this way, at some distance from the beginning of the transport path—adjacent the first vacuum chamber 12 in the example shown—hot bitumen 17 flows onto the band of carrier material lying on the screen belt.

Then, owing to the reduced pressure prevailing in the vacuum chambers, the hot bitumen is sucked into and through the band of carrier material, so that the carrier material is completely soaked with bitumen. Trapped air is thereby driven out, so that the chances of local air inclusions are eliminated entirely. Since during bituminization the carrier material is completely supported and transported by the screen belt, no tensile forces, or hardly any, are exerted on the carrier material during bituminization. Accordingly, the manufacturing process imposes hardly any requirements on the mechanical stability of the carrier material. As a result, it is possible to use as carrier material, material that is much slacker and hence much more pliable than the traditional materials. As an example can be mentioned polyester cloth which has not been stabilised or has been so to a lesser extent. Suitable carrier materials that can lead to very pliable roofing materials are, for instance, non-woven materials based on polyester or polypropene or other polymeric fibres which have not undergone any post-treatment and which are slightly fluffy. For the sake of completeness, it is observed that with the method and apparatus according to the invention, the traditional materials can, of course, be processed as well.

Owing to the hot bitumen being sucked into and through the carrier material, a very good bond between the bitumen and the inlay is produced, which can be additionally promoted by the use of fluffy materials which were not usable as inlay according to the prior art.

Excess bitumen which reaches the vacuum chambers via the screen belt can drain via outlet openings 18, 19, 20 at the bottom of the vacuum chambers and thereupon be received in a diagrammatically indicated sump 21. The supporting and return rollers can advantageously be heated in order to prevent caking of bitumen.

Further, if desired, a stripper means, for instance a stripping beam, can be provided, which skims excess bitumen at the top. Such a beam is diagrammatically shown, by way of example, at 22. The thus bituminized band can, if desired, be subsequently provided with a coating of a different type of bitumen or even a different material. To that end, any of the devices known for that purpose, or optionally a similar screen belt device to chat described above, can be used. Then the band can be fed to a conventional cooling system.

Without any objection, the carrier material can be fed to the screen bent while having one or two folded longitudinal edges 41 (see FIG. 3) for obtaining a reinforced peripheral area of increased tear strength. As a result, the possibilities of using a slack carrier material of slight tensile strength are further augmented. Alternatively, at the or both longitudinal edges, narrow loose strips of materials can be supplied, which come to lie on top of or under a peripheral strip or the carrier material or are folded about the edge of the carrier material. It is also possible to arrange one or more (additional) longitudinal wires or strings along the edges, alone or in combination with folded or loose edge strips.

Figure 3:
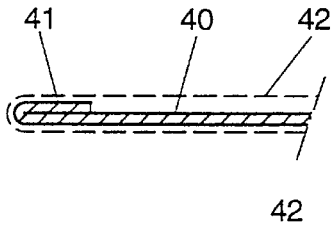
FIG. 3 schematically shows in cross section an example of a product manufactured with the apparatus or the method according to the invention.

FIG. 3 schematically shows in cross section an example of a carrier material 40 with a folded longitudinal edge 41 and provided with bitumen 42. The carrier material can consist of several layers. The strengthened edge 41 can be used to mechanically secure the material to an underlying surface, for instance with nails or the like.

Figure 4:
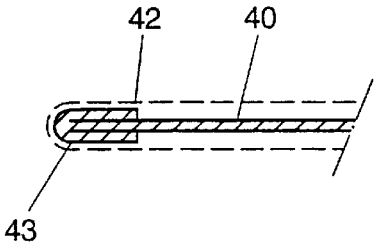
FIG. 4 shows two other examples of a product manufactured according to the invention.
Figure 4:
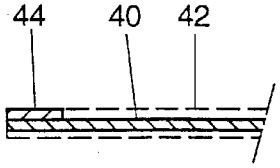

FIG. 4 shows, by way of example, a roofing material with, respectively, a separate strip 43 folded over a longitudinal edge and a narrow strip 44 lying loosely on a longitudinal edge.

Figure 2:
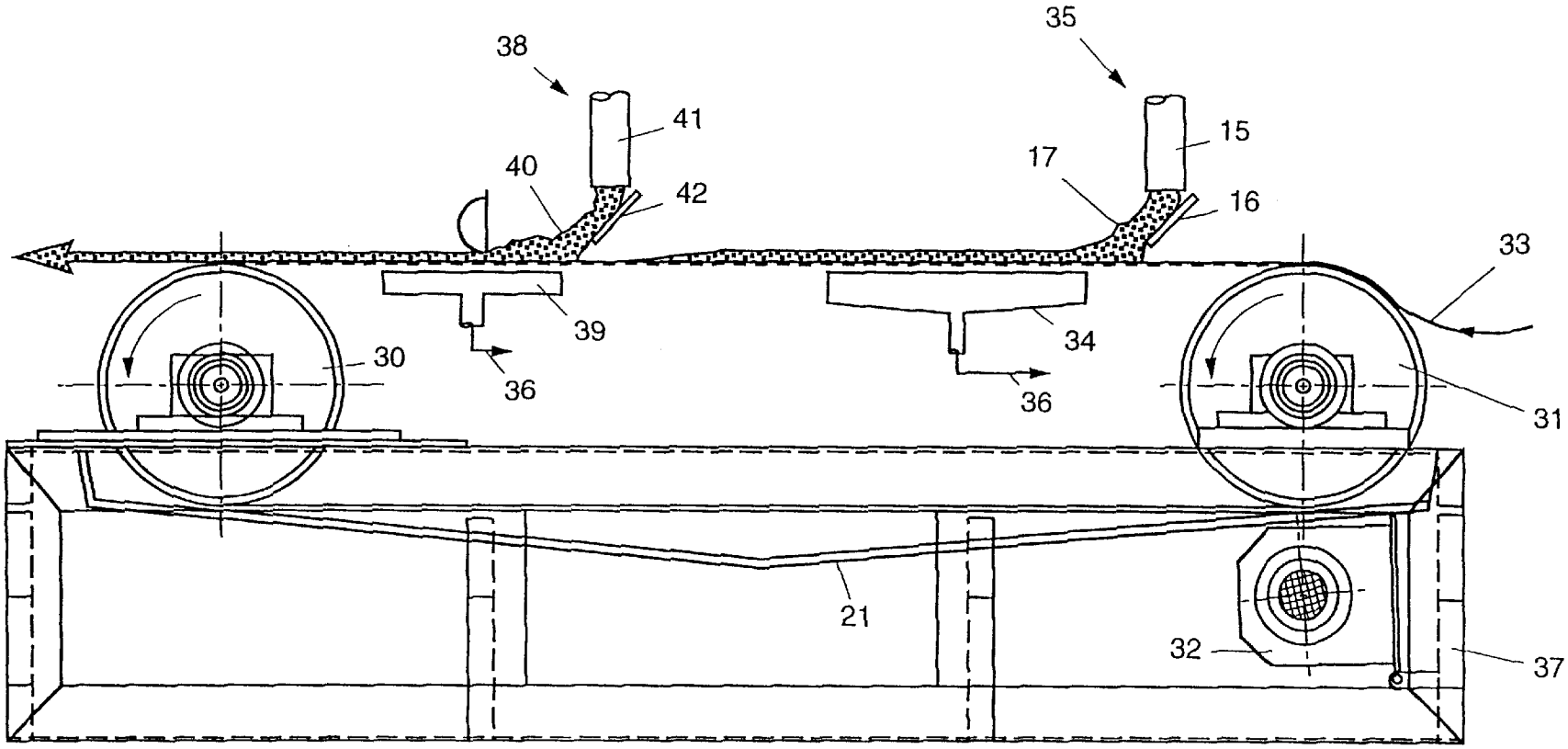
FIG. 2 schematically shows an elevation of another example of an apparatus according to the invention.

FIG. 2 schematically shows another example of ail apparatus according to the invention. The apparatus again comprises a belt 2 provided with openings, which in this example has been passed over two preferably warmed return rollers or drums 30, 31, the return roller 31 being drivable by a motor 32. In this example, the carrier material 33 is supplied from the right-hand side (viewed in FIG. 2) and the screen belt moves to the left, at least in the upper path. By means of a supply device 15 for hot impregnating bitumen and a distributing device 16, in a first bituminizing station 35 bitumen is provided on the carrier material lying on the screen belt, as shown at 17. The hot bitumen is sucked into and through the carrier material above a vacuum chamber 34, which is connected to a device for providing a reduced pressure, or a vacuum system, as diagrammatically indicated with an arrow 36. The vacuum chamber in turn is covered by or arranged under a perforated plate or a grid or the like, supporting the screen belt.

In the frame 37 of the apparatus shown, again a sump 21 for excess bitumen is arranged.

In this example, the first bituminizing station is followed by a second bituminizing station 38, located above the same screen belt, where coating bitumen 40 can be applied. It desired, this can be effected through a second vacuum chamber 39, likewise connected to a device for providing a reduced pressure. The bituminizing station 38 again has a hot bitumen supply device 41 and a distributing device 42. Further, a stripping beam 43 is shown, which also has a distributing function.

However, the coating can also be applied in a different manner and/or consist of different material from bitumen.

For some applications, it is desired that the eventual product has open pores. In that case, the coating can be omitted.

Figure 5:
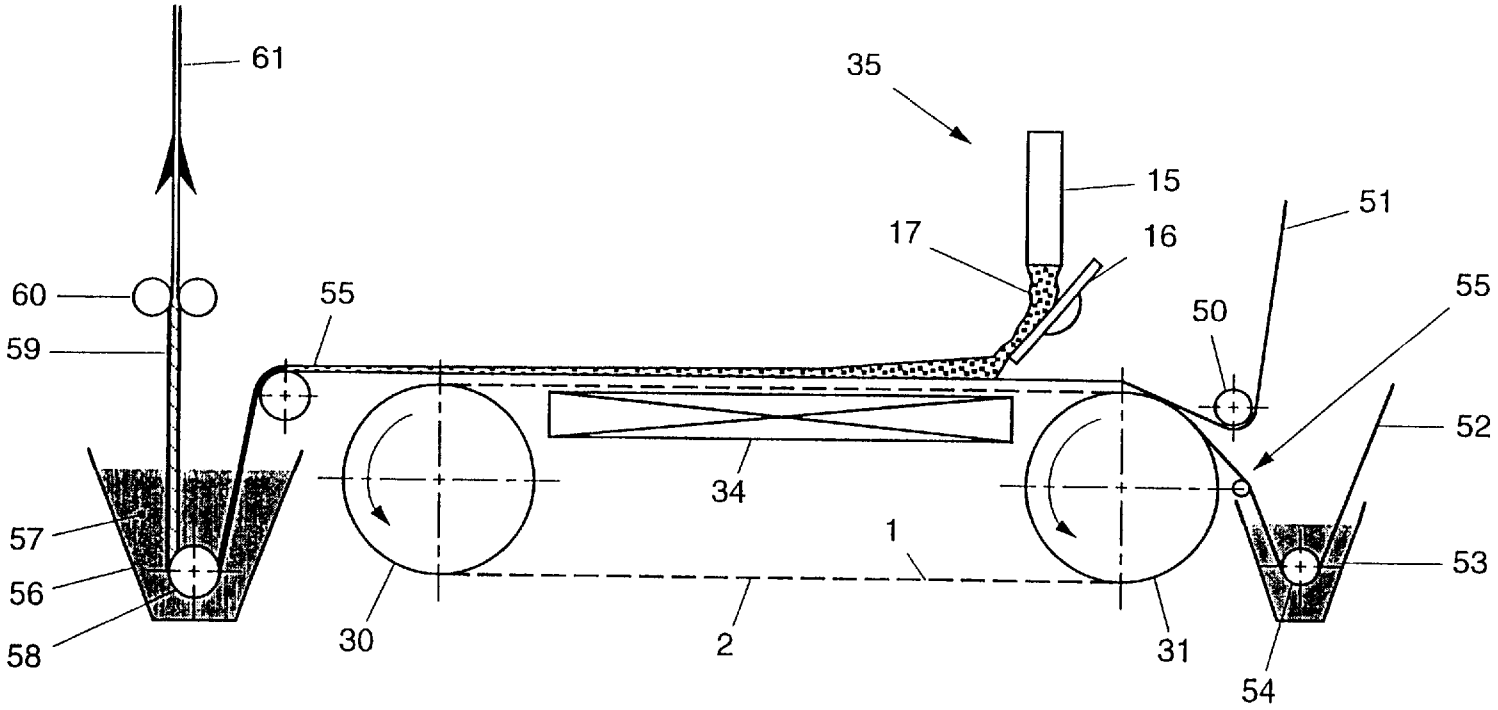
FIG. 5 schematically shows a side elevation, partly in cross section, of yet another example of an apparatus according to the invention.

FIG. 5 diagrammatically shows in side elevation, and partly in cross section, yet another example of an apparatus according to the invention. In FIG. 5, the same reference numerals as in FIG. 2 have been used for corresponding parts. An endless screen belt 2 provided with openings lies over two preferably heated return rollers or drums 30 and 31, of which, at least one is drivable. The upper run of the screen belt, as viewed in the drawing, moves from the right to the left over at least one vacuum chamber 34, which may or may not be compartmented.

Located above the screen belt is at least one bituminizing station 35, with a supply device 15 for hot bitumen 17 and a distributing device 16. Prior to the bituminizing station, via a roller 50, the inlay or band of carrier material 51 is fed to the screen belt. If desired, an inlay consisting of several layers, which may of may not consist of different materials, can be used. In the example shown, a duplex inlay is used, which consists of the band of carrier material 51 and an auxiliary inlay 52 fed under the band 51. The bands 51 and 52 can, if desired, be simultaneously impregnated with bitumen. In the example shown, the band 52 is pre-soaked in a bath 53 or the like, filled with a hot impregnating bitumen, before the band 52 is fed between the screen belt and the band 51. To that end, a roller 54 is arranged in the bath 53, which roller 54 guides the band 52. In a similar manner, more than two layers can be processed as well.

It is possible to add additives by scattering these onto auxiliary inlay 52, which may or may not be pre-soaked, before it is covered by the other band of carrier material 51. This is schematically indicated with an arrow 55. However, the additives can also have been added to the bitumen in the bath 53 and/or the bitumen 17, or be provided on a dry layer of material by scattering, spraying, soaking and the like. In this way, for instance fillers, flame-extinguishing or root growth inhibiting substances or materials can be added.

On the screen belt, the single or multiple inlay is passed over one or more vacuum chambers and impregnated with bitumen in one or more steps. The bitumen in the bath 53 and the bitumen that is provided in one or more stations above a screen belt can, if desired, have different compositions. Similarly, in the case of a multiple inlay, the different layers can consist of different materials. In the example shown in FIG. 5, the band 51 can consist, for instance, of fluffy polyester material, while the band 52 can consist, for instance, of glass fibre web. After the impregnating process, which, as already noted, can occur in one or more steps and which can also be carried out on a single screen belt device or a number of successive screen belt devices, a coating is provided in any of the manners suitable therefor. Usually, a coating is provided on both sides of the impregnated inlay.

It has been found that when the method according to the invention is used, a very good bonding of the coating is obtained, thereby avoiding the shear effect which sometimes occurs between the impregnated inlay and the coating when using bituminized roofing material on an inclined roof surface. This is probably a consequence of the fact that owing to the vacuum technique a better impregnation occurs and that the relief of the inlay is maintained to a relatively large extent even after the impregnating process, so that the coating exhibits better bonding.

In the example shown in FIG. 5, the coating is applied by passing the impregnated carrier band 55 through a bath 56 with suitable coating material 57, for instance by means of a roller 58. In this example, the coated material band 59 is passed in vertical direction between two calibrating rollers 60, whereafter the thus obtained band of roofing material 61 can be further processed, for instance by providing an anti-adhesive layer, cooling, rolling up and packaging, et cetera. However, if desired, calibration can also be performed with the aid of two rollers arranged above each other, between which the band of roofing material is passed in horizontal direction.

Experiments have shown that the use of the above-described vacuum technique allows working at a lower temperature of the hot bitumen, which can be considered an additional advantage.

It is noted that after the foregoing, various modifications will readily occur to those skilled in the art. Thus, for instance, in replacement of the screen belt, use can be made of one or more screen cylinders, which support the carrier material on a part of their circumferential surface and which are provided on their inside with one or more vacuum chambers.

Further, the pressure difference across the supporting surface, of course, can also be created by raising the pressure on one side, optionally in combination with a lower pressure on the other side. The bitumen can, for instance, be supplied to the material band under increased pressure. Also, the material band could be bituminized in vertical position using a pressure difference. Furthermore, in a horizontal system as described hereinbefore, the vacuum chamber could be located, for instance, above the supporting surface, while the bitumen is supplied from the underside.

Further, in addition to the pliable carrier materials mentioned, other pliable carrier materials as well as carrier materials of the traditional type can be processed.

These and similar modifications are understood to fall within the scope of the invention.

I claim:

1. A method for manufacturing bands of bituminized roofing material by the impregnation of a band of porous carrier material with bitumen, including the steps of arranging the band of porous carrier material on an upper side of a supporting surface having openings, placing hot bitumen on a side of the band of carrier material remote from the supporting surface, and creating a pressure differential across a portion of the supporting surface between the upper and lower side of the supporting surface, whereby the hot bitumen penetrates into the carrier material.

2. A method according to claim 1, wherein the step of creating a pressure difference across a portion of the supporting surface is performed on at least one side of said supporting surface.

3. A method according to claim 1, further including creating a pressure difference by feeding the hot bitumen to the band of carrier material under excess pressure.

4. A method according to claim 1, wherein the supporting surface extends generally horizontally.

5. A method according to claim 1, wherein the supporting surface comprises a traveling surface of a conveying apparatus.

6. A method according to claim 5, wherein the supporting surface comprises a screen belt.

7. A method according to claim 5, wherein the supporting surface comprises a screen cylinder.

8. A method according to claim 1, wherein after the bitumen has penetrated into the carrier, providing the bituminized carrier with a coating on at least one side.

9. A method according to claim 8, further including applying the coating with vacuum.

10. A method according to claim 8 further including passing the coated impregnated carrier in vertical direction between two calibrating rollers.

11. A method according to claim 1 further including using carrier material consisting of one or more layers.

12. A method according to claim 11, further including using carrier material with at least two layers of different material.

13. A method according to claim 11, further including providing an additive selected from the group consisting of filler, flame retardants, and growth inhibitors to at least one of the layers of carrier material, prior to being joined with the other layers of the carrier material.

14. A method according to claim 1, wherein the carrier material comprises a pliant web material of low tensile strength.

15. A method according to claim 1, further including using a band of carrier material with at least one strengthened longitudinal edge.

16. A method according to claim 1, including first soaking at least one of the layers of carrier material in hot bitumen material.

17. A method according to claim 16, wherein the bitumen material used for soaking has a different composition from the composition of the bitumen provided after soaking in the carrier comprising a number of layers.

18. A method according to claim 1, wherein the carrier material comprises a layer of fluffy material.

19. A method according to claim 1, further including carrying out the impregnation of the carrier material in steps.

* * * * *